United States Patent [19]

Alman et al.

[11] 4,213,112

[45] Jul. 15, 1980

[54] VARIABLE RESISTANCE POTENTIOMETER

[75] Inventors: Donald W. Alman, Whittier; Paul F. Gerwitz, West Covina; Charles M. Tygard, Diamond Bar, all of Calif.

[73] Assignee: Carrier Corporation, Syracuse, N.Y.

[21] Appl. No.: 4,968

[22] Filed: Jan. 22, 1979

[51] Int. Cl.[2] ..... H01C 10/44

[52] U.S. Cl. ..... 338/183; 338/176; 338/180

[58] Field of Search ..... 338/183, 180, 181, 176, 338/160

[56] References Cited

U.S. PATENT DOCUMENTS

| | | | |
|---|---|---|---|
| 3,732,521 | 5/1973 | Havenstine et al. | 338/183 X |
| 3,928,838 | 12/1975 | Leppek | 338/183 |
| 4,021,768 | 5/1977 | Stuckey | 338/183 X |

*Primary Examiner*—C. L. Albritton

*Attorney, Agent, or Firm*—J. Raymond Curtin; Donald F. Daley

[57] ABSTRACT

A potentiometer including a resistance element positioned within the housing. The resistance element comprising a substrate and a resistive track deposited thereon has a collector element and three terminating pads electrically connected to each end of the resistance track and to the collector element. A slidable wiper is electrically connected to the collector element and contacts the resistance track to vary the resistance of the circuit. Clips are mounted on the resistance element to provide electrical connections between the terminating pads and terminal posts connecting the resistance element to an external circuit. The clips are formed of an S-shaped, resilient, electrically conductive element having lower and intermediate sections to resiliently clamp the resistance track, and an upper section with two bifurcated arms to engage the terminal post. The clips provide an electrical connection, retain the terminal posts in the housing, and bias the substrate against tracks in the housing to secure the substrate, to absorb vibrations and to compensate for dimensional changes resulting from temperature fluctuations.

2 Claims, 6 Drawing Figures

VARIABLE RESISTANCE POTENTIOMETER

BACKGROUND OF THE INVENTION

1. Field of the Invention

The present invention relates generally to variable resistance potentiometers and, more specifically, to a potentiometer having clips to provide contact between the terminal posts connecting the external circuit and resistance element.

2. Description of the Prior Art

Standard potentiometers include a housing within which is mounted a resistance element having a resistance track thereon and a wiper element or contact member adapted for relative movement with respect to the resistance track. The resistance track and wiper element are connected in an electrical circuit whereby relative movement between the wiper element and resistance track varies the resistance between the wiper element and each of the resistance track terminating pads.

In some applications the potentiometers are subject to undesirable conditions, as for example, in automotive equipment. The undesirable conditions may be caused by vibrations exerted in automotive equipment during its operation. Under such conditions the conventional solder joints made in connections between the terminating pads at the end of the resistance track and the terminal posts of the electrical circuit connected thereto, are not reliable and may cause a break in electrical circuit. Such damage may result in relatively costly repairs and inoperability of the potentiometer. Therefore, it is highly desirable to prevent the resistance element and electrical connections in the circuit from damage caused by vibrations or mechanical stress. The resistance element and the terminal posts must be held in place, there must be compensation for dimensional changes due to temperature fluctuations and vibrations must be absorbed at the same time providing reliable electrical connections between the electrical tracks of the resistance element and the terminal posts.

SUMMARY OF THE INVENTION

It is an object of this invention to improve potentiometers by providing a unitary means to retain the terminal posts in the potentiometer housing, to hold the resistance element in position and absorb vibrations and dimensional changes due to temperature fluctuations, and to provide electrical connection between the terminal posts and the tracks on the resistance element.

A more specific object of the present invention is to provide a clip for a potentiometer which serves as an electrical connector between the resistance track and the terminal posts.

Another object of the present invention is to provide a clip means of the foregoing type which is simple in construction, reliable in operation, and easy to fabricate.

The preceding objects are attained, according to a preferred embodiment of the invention, by the provision of a potentiometer with a clip resiliently clamping the resistance element and arranged to hold the terminal posts in the housing and connect the posts to the electrical circuit of the resistance element. The clip is mounted in the potentiometer housing in a prestressed position and is formed of an upper section, an intermediate section and a lower section. The upper section has two bifurcated arms which are laterally deflectable to engage the terminal posts at an undercut portion of the post. The clip is mounted over the resistance element with the upper portion pressing against the housing to absorb vibrations effecting the resistance element during the operation.

DESCRIPTION OF THE PREFERRED EMBODIMENT

Figure 1:
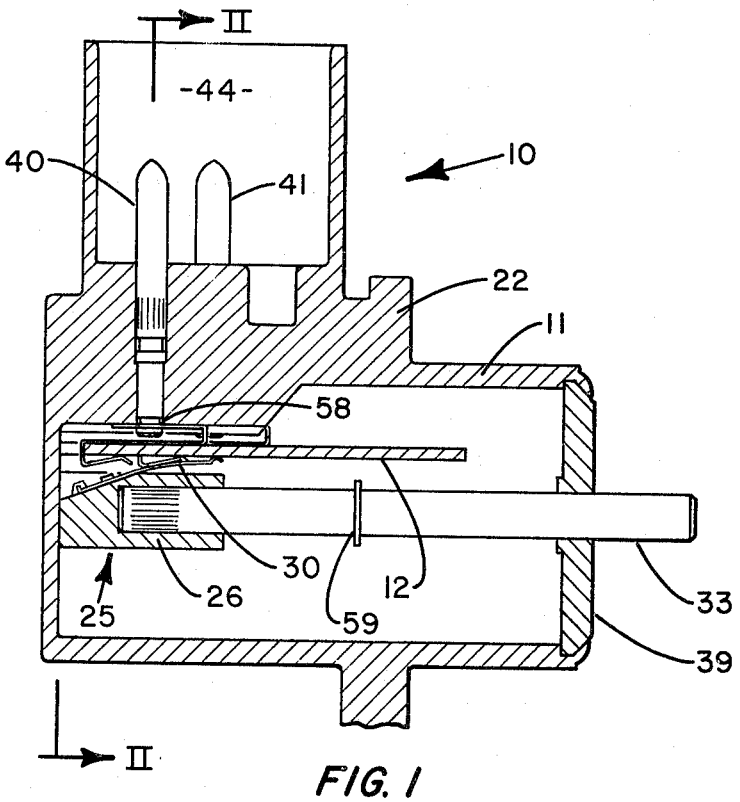
FIG. 1 shows a cross-sectional view of the preferred embodiment of the invention taken along line I—I of FIG. 2.
Figure 2:
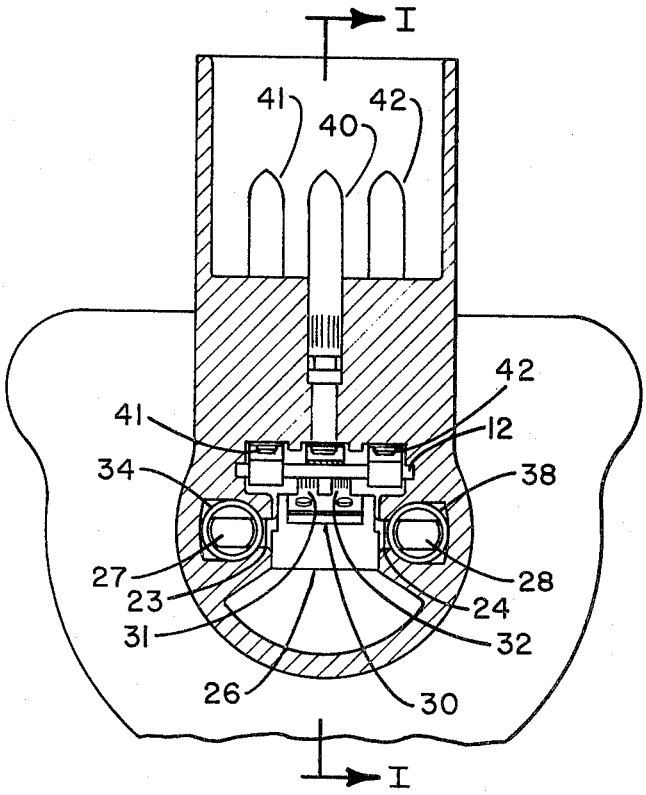
FIG. 2 is a sectional view taken along line II—II of FIG. 1.
Figure 3:
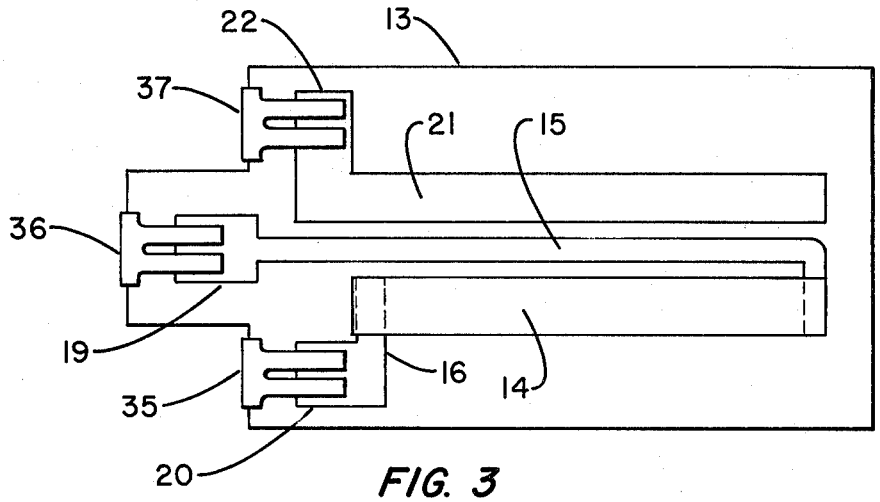
FIG. 3 is a plan view of a resistance element with clips mounted thereon.

In FIGS. 1 and 2 a potentiometer, in accordance with the teachings of this invention, is shown. The device generally indicated by the numeral 10 includes a housing 11 within which a resistance element 12 is mounted. Resistance element 12, as seen in FIG. 3, comprises a base plate or substrate 13 formed of any suitable non-conductive material such as alumina, glass or plastic. A resistance track designated as 14 has been applied onto the substrate 13 by coating or spraying different types of resistive material. Resistance element 12 is installed into the assembly with resistance track 14 on its bottom side. Electrical conductors 15 and 16 are formed on the substrate 13 in electrical connection with each end of resistance track 14. Conductors 15 and 16 terminate in terminating pads 19 and 20 respectively. A conductive track or collector element 21 is positioned on substrate 13 in a parallel and spaced relationship to resistance track 14 and conductor 15. The configuration of conductors 15, 16 and conductive track 21 may be suitably modified to meet the requirements of particular applications. Conductive track 21 terminates in a terminating pad 22. Terminating pads 19, 20 and 22, conductors 15 and 16 and conductive track 21 are preferably comprised of a film of copper, silver or other suitable conductive material.

As seen in FIGS. 1 and 2, at the lower portion of housing 11, below resistance element 12, there is mounted a wiper assembly 25. Wiper assembly 25 includes a carrier 26 which carries a multifingered wiper element 30. Multifingered wiper element 30 is split into two connected portions 31 and 32, FIG. 2, which are adapted to slidably contact resistance track 14 and conductive track 21 respectively. Carrier 26 has two ears 27 and 28, FIG. 2, adapted to ride in tracks 23 and 24 formed in housing 11. Tracks 23 and 24 are formed as integral portions of housing 11 to provide a guide for ears 27 and 28 during the movement of the contact carrier relative to resistance element 12. An actuating shaft 33 is connected to carrier 26 and extends outward of housing 11. Shaft 33 is arranged to slidably move carrier 26 in the tracks 23 and 24 formed in housing 11 so that the wiper element 30 moves along tracks 14 and 21 of resistance element 12. In order to bias shaft 33 outwardly of the housing, two spring members 34 and 38 are provided within tracks 23 and 24. Actuating shaft 33 is formed with a stop ring 59 to limit shaft movement outwardly of the housing. Housing 11 is provided with a cover plate 39 and has a socket 44 adapted to receive a mating plug.

Each terminating pad 19, 20, or 22 is engaged by a contact clip 35, 36 or 37. These contact clips are formed of electrically conductive material and adapted to resiliently clamp the thickness of resistance element 12 at locations of terminating pads 19, 20 and 22. The configuration of contact clips provides a reliable electrical connection between the terminating pads 19, 20 and 22 and terminal posts indicated by 40, 41 and 42.

Figure 4:
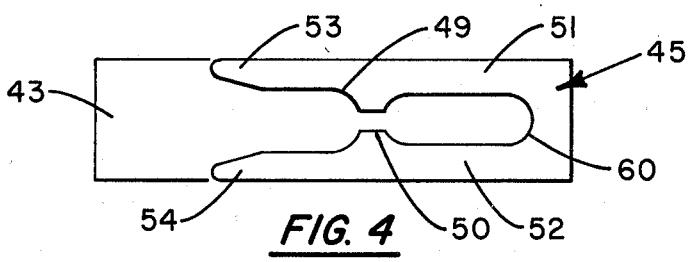
FIG. 4 is a top view of a contact clip according to the present invention.
Figure 5:
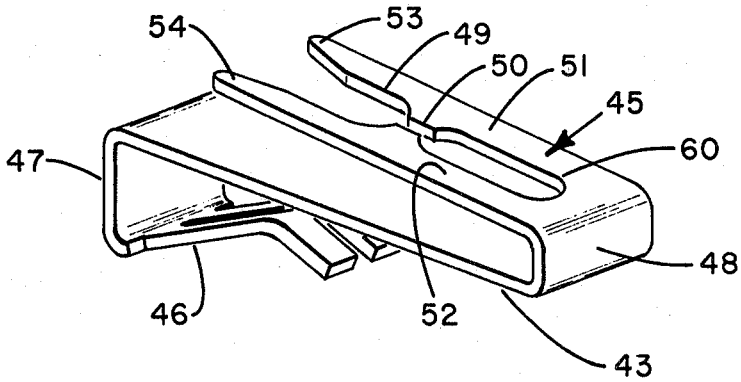
FIG. 5 is an isometric view of the contact clip shown in FIG. 4.
Figure 6:
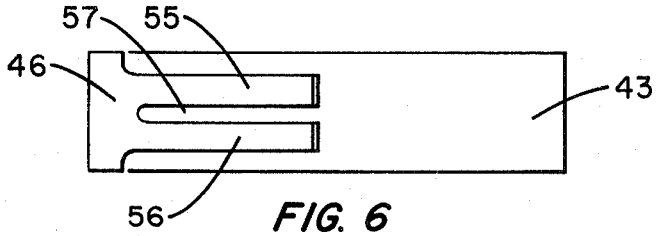
FIG. 6 is a bottom view of the contact clip shown in FIG. 4.

Referring to FIGS. 4, 5, 6, it can be seen that the electrical contact clip is an integral resilient member composed of an intermediate section 43, a planar upper section 45 and a bottom section 46. Upper section 45 and bottom section 46 are disposed on different sides of the intermediate section 43 and are connected to the intermediate section by lateral sections 47 and 48. The upper and bottom sections are bent relative to intermediate section 43. Upper section 45 is formed with a longitudinal slot 49 to receive the terminal post 40, 41 or 42. Upper section 45 is also formed with a slit 50 opening into a second longitudinal slot 60 which together with the slot 49 provides two bifurcated arms 51 and 52 extending towards the lateral section 48. The slit 50 provides a stop position for the terminal post 40, 41 or 42 and allows arms 51 and 52 to be deflected upon insertion of terminal post 40, 41 or 42 between arms 51 and 52. Ends 53, 54 of arms 51, 52 form, along with slot 49, surfaces to provide a guide for terminal post 40, 41 or 42 when inserted into slot 49.

Bottom section 46 contains two legs 55 and 56 which are rectangular in a shape and are formed to be concaved towards the clip intermediate section 43. The shape of the legs 55 and 56 form a spring-like surface for providing line contact between the electrical contact clips and terminating pads 19, 20 or 22. The two legs of the bottom section 46 are formed by a slit 57 extending from the lateral section 47 of the contact clip to the ends of legs 55 and 56. In the assembly, the contact clip is mounted over resistance element 12 with upper section 45 pressing against housing 11, as seen in FIG. 1, in a deflected position. The intermediate section 43 bears on the top of element 12 and bottom section 46 of the contact clip resiliently engages the bottom of resistance element 12 at the terminating pads 19, 20 or 22. The spring-like contact of the bottom concaved section 46 of the contact clip with resistance track 14 and wiper track 21 provides reliable electrical connection with the resistance track. The upper section 45 of each contact clip 35, 36 or 37 engages terminal post 40, 41 or 42 by inserting into slot 49. Each terminal post is formed with an undercut portion 58 by which terminal post 40, 41 or 42 slides into slot 49 between ends 53 and 54 of arms 51 and 52. Slit 50 serves as a stop position for the terminal post to prevent its further sliding between arms 51 and 52. The ends 53 and 54 of arms 51 and 52 resiliently engage the undercut portion of terminal post 40, 41 or 42. In the assembly the planar upper section 45 is prestressed providing a dependable electrical connection between the terminal post and the electrically conductive contact clip. Engagement of the undercut portion of the post by the prestressed upper section of the contact clip provides a reliable retaining means for the posts 40, 41 and 42.

Consequently, the contact clip engaging simultaneously resistance track 14 and terminal posts 40, 41 or 42 provides safe electrical connections in all points of the circuit, holds the posts in place and absorbs vibrations.

As actuating shaft 33 is moved in housing 11, the contact area between wiper element 30 and resistance element 12 varies in position along the length of the element changing the resistance value between terminating pad 22 and either of terminating pads 19 and 20 thereby providing the variable resistance function of the apparatus. In operation, as for example, in automotive equipment, contact clips offset loads exerted on the assembly acting as damping means and thus preventing the resistance element and electrical connections in the assembly from vibrations.

While the present invention has been described in connection with the particular embodiment, it is to be understood to those skilled in the art that various modifications may be made without departing from the scope of the appended claims.

What is claimed is:

1. A potentiometer including a housing, a resistance element positioned within the housing having a base member of an electrically insulating material, an electrical resistance track mounted on one side of the base member, an electrically conductive track mounted on the same side of the base member in spaced relationship with the resistance track, and electrical conductors mounted on the same side of said base member, and electrically connected to the opposite ends of the resistance track, said electrical conductors and said conductive track terminating in terminating pads to provide input and output terminals for said resistance track and conductive track, a contact member having first and second electrically connected wiper sections arranged in slidable contact with the resistance track and the conductive track respectively, carriage means within the housing to support the contact member for slidable movement along the length of said resistance track and conductive track, actuating means extending into the housing to move the carriage means and the contact member with respect to the resistance element, terminal posts to connect said terminating pads to an external electrical circuit, one end of said terminal post extending into the housing adjacent to the terminating pads of the electrical conductors and conductive track of the resistance element, and having an undercut portion within the housing, clip means to electrically connect the terminating pads of the resistance track and the conductive track of the resistance element to said terminal posts in the housing, each clip comprising an S-shaped, resilient, electrically conductive member having an upper section, an intermediate section and a lower section, the intermediate section and the lower section positioned to straddle and resiliently clamp the resistance element, said lower section being formed with two legs which are concaved toward the intermediate section and positioned in electrical contact with one of the terminating pads, and the upper section positioned in a spaced relationship with said intermediate section and having bifurcated arms which are laterally deflectable to engage the undercut portion of the terminal posts, thereby holding the resistance element and the terminal posts in position and providing reliable electrical contact between the resistance element and the external electrical circuit in undesirable operation conditions caused by vibrations.

2. The potentiometer according to claim 1, wherein the clip means are mounted in an assembly in a prestressed position to provide reliable electrical contact between the resistance element and said terminal posts.

* * * * *

UNITED STATES PATENT AND TRADEMARK OFFICE

CERTIFICATE OF CORRECTION

PATENT NO. : 4,213,112

DATED : July 15, 1980

INVENTOR(S) : Donald W. Alman, et al

It is certified that error appears in the above-identified patent and that said Letters Patent are hereby corrected as shown below:

In item [73] on the first page of the patent, "Carrier Corporation, Syracuse, New York" should be --Spectrol Electronics Corporation, City of Industry, California--.

Signed and Sealed this

*Fourth* Day of *November 1980*

[SEAL]

*Attest:*

SIDNEY A. DIAMOND

*Attesting Officer*

*Commissioner of Patents and Trademarks*